US007062815B1

(12) United States Patent
Richardson

(10) Patent No.: US 7,062,815 B1
(45) Date of Patent: Jun. 20, 2006

(54) BACK SCRUBBER

(76) Inventor: Robert E. Richardson, 370 53rd Ave. North, Lot #410, St. Petersburg, FL (US) 33703

( * ) Notice: Subject to any disclaimer, the term of this patent is extended or adjusted under 35 U.S.C. 154(b) by 0 days.

(21) Appl. No.: 10/799,275

(22) Filed: Mar. 12, 2004

(51) Int. Cl.
*A47K 7/04* (2006.01)

(52) U.S. Cl. ..... 15/21.1; 4/606; 601/114

(58) Field of Classification Search ..... 15/21.1, 15/88.3; 601/112, 114, 136; 4/606
See application file for complete search history.

(56) References Cited

U.S. PATENT DOCUMENTS 2,876,765 A * 3/1959 Day ..... 601/114
3,091,776 A * 6/1963 Roberts ..... 4/606
3,196,867 A * 7/1965 Perry ..... 601/114
3,529,593 A * 9/1970 Perry ..... 601/114
3,678,523 A * 7/1972 Enchelmaier et al. ..... 15/88.3
3,802,421 A * 4/1974 Williams ..... 601/114
4,008,503 A * 2/1977 Tharp ..... 15/88.3
4,040,132 A * 8/1977 Braun ..... 4/606
6,058,545 A * 5/2000 Roach ..... 15/97.1
6,581,219 B1 * 6/2003 Powaska ..... 4/606

FOREIGN PATENT DOCUMENTS

DE 2843683 * 4/1980
DE 19849342 * 5/2000
GB 2269096 * 2/1994

* cited by examiner

*Primary Examiner*—Mark Spisich
(74) *Attorney, Agent, or Firm*—Kenneth L. Tolar

(57) ABSTRACT

A back scrubber includes a substantially U-shaped bracket including an elongated vertical base plate with an upper arm and a lower arm perpendicularly extending therefrom. Removably positioned between the upper and lower arms is a tubular brush member that is automatically rotated with an internal electric motor. A bather can cleanse his her or back by activating the motor and placing the back against the brush member.

3 Claims, 2 Drawing Sheets

BACK SCRUBBER

BACKGROUND OF THE INVENTION

1. Technical Field of the Invention

The present invention generally relates to a back scrubber, specifically, a wall mounted device that includes a motor driven brush for automatically scrubbing a bather's back.

2. Description of the Prior Art

The back has always been one of the most difficult areas of the body to wash. Although various back scrubbers exist, they typically include an elongated handle with a brush head at an end thereof. The user is required to manually reciprocate the brush head across the back, which is not only laborious, but is also marginally effective, at best. Accordingly, there is currently a need for a device that more effectively and efficiently cleans a user's back.

The present invention addresses the above described need by providing a uniquely designed back scrubber that is conveniently mounted on a shower or bathtub wall. The scrubber includes a motorized scrubbing brush for automatically cleansing the bather's back.

SUMMARY OF THE INVENTION

The present invention relates to a back scrubber. The device comprises a substantially U-shaped bracket including an elongated vertical base panel with an upper arm and a lower arm perpendicularly extending therefrom. The lower arm includes a water impermeable chamber with an electric motor and associated batteries received therein. A tubular scrubbing brush is disposed between the arms and is rotatably driven by the electric motor. Accordingly, by activating the motor, the brush is automatically rotated allowing a bather to place his or her back thereagainst for cleansing.

It is therefore an object of the present invention to provide a back scrubber that automatically cleanses a user's back.

It is another object of the present invention to provide a back scrubber that allows for hands free cleansing of a user's back.

It is yet another object of the present invention to provide a back scrubber that is conveniently mounted on a bath or shower wall.

Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
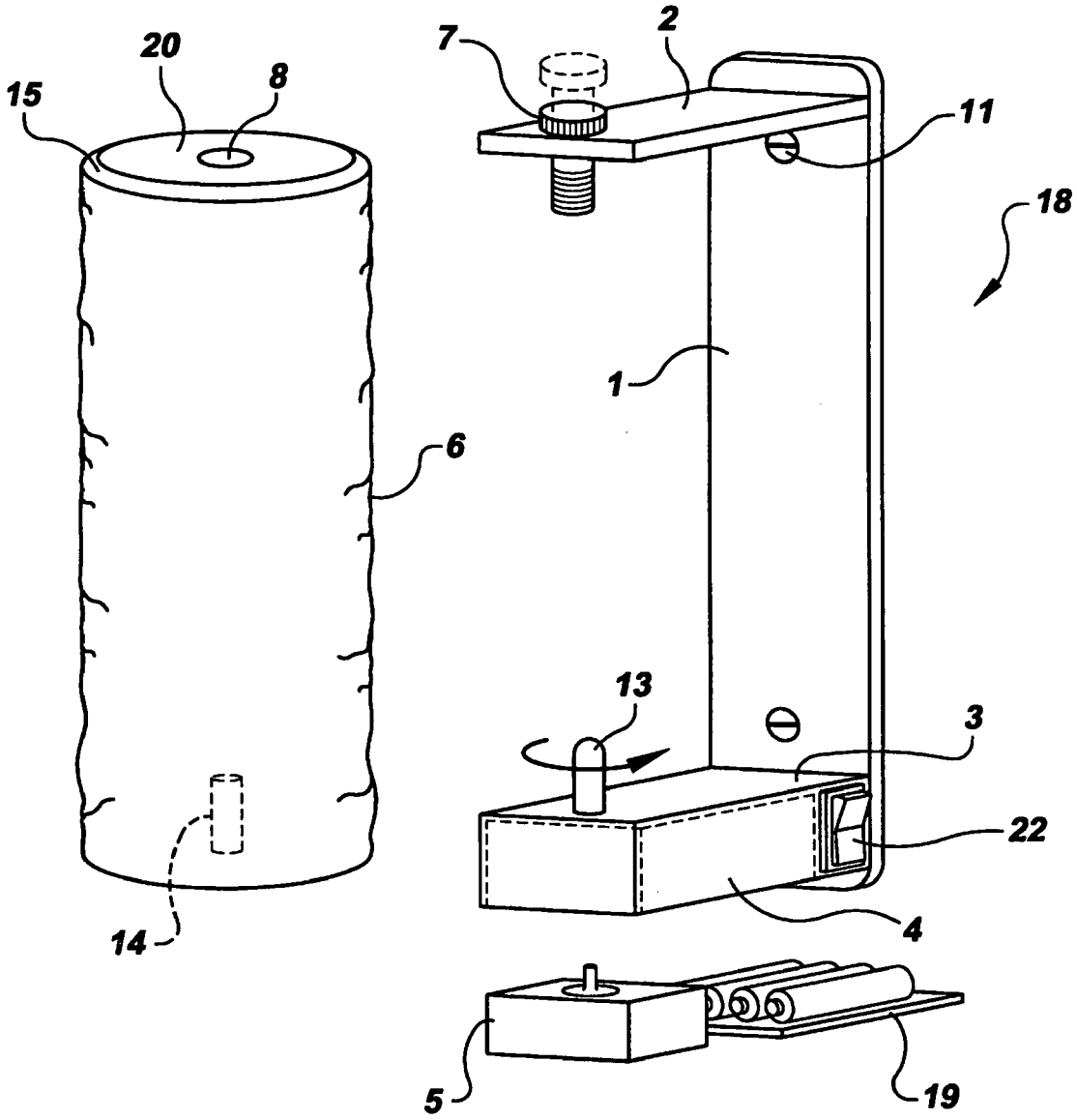
FIG. 1 is a partially exploded, perspective view of the back scrubber according to the present invention.
Figure 2:
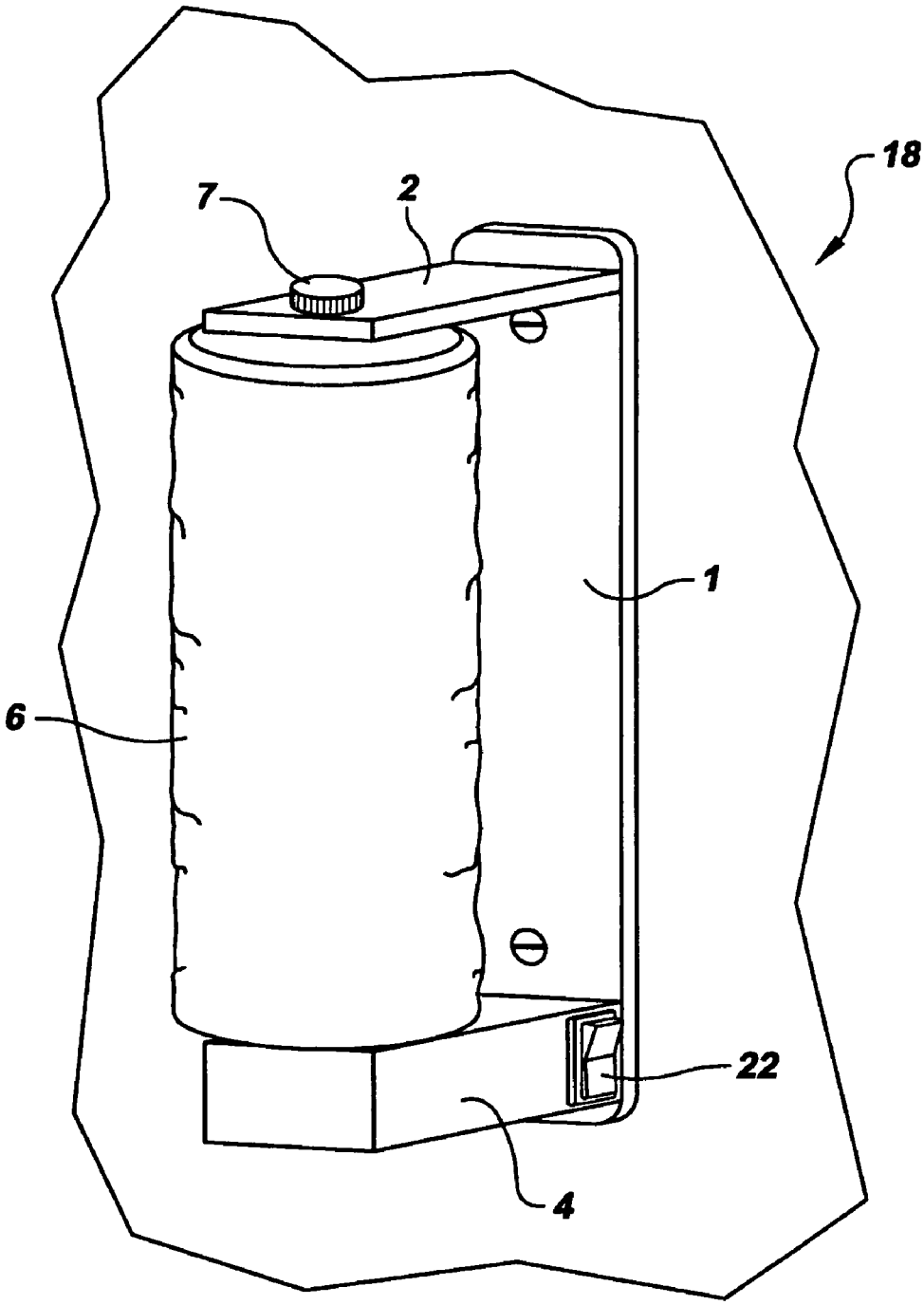
FIG. 2 is a perspective view of the back scrubber mounted on a shower wall.

Referring now to FIGS. 1 and 2, the present invention relates to a motorized back scrubber. The device comprises a substantially U-shaped bracket including an elongated vertical base panel 1 with an upper arm 2 and a lower arm 3 perpendicularly extending therefrom. The lower arm includes a water impermeable chamber 4 with an electric motor 5 and associated batteries 19 received therein for rotating a brush member, described, infra. A switch 22 is positioned on the bracket for activating the motor. The base panel is secured to a support surface, such as a shower or bathtub wall, using screws 11, suction cups or any other similar means.

Removably disposed between the arms is a tubular brush member 6 having a central core 20. Depending from the upper arm is a spring-biased pin 7 that is receivable within a bore 8 at an upper end of the core. A peg 13 is operably connected to the motor and upwardly extends from the lower arm. The peg is tightly receivable within a bore 14 at the lower end of the core. The brush member can be easily attached to the bracket by placing the lower bore over the peg while simultaneously lifting the pin to allow the upper end of the core to be positioned therebeneath. Accordingly, when the brush member is properly positioned on the bracket as described above, rotation of the peg results in rotation of the brush member.

The brush member is further composed of any one of a plurality of interchangeable, cylindrical cleansing sleeves 15 removably encompassing the central core. Each sleeve includes a discrete exterior surface such as loofah, terry cloth, bristles, etc., allowing a user to vary the brush type according to a particular application or preference.

As is now readily apparent, the present invention provides a back scrubber that efficiently cleanses a user's back. By activating the motor with the switch 22, the brush member is automatically rotated allowing a bather to place his or her back thereagainst for hands free cleansing.

The above described device is not limited to the exact details of construction and enumeration of parts provided herein. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A back scrubber comprising:

a substantially U-shaped bracket mounted on a support surface, said bracket including an elongated vertical base panel with an upper arm and a lower arm perpendicularly extending therefrom;

a tubular brush member disposed between said upper arm and said lower arm, an upper end and a lower end, said upper end and said lower end each having a bore thereon, said brush member also including a central core encompassed by any one of a plurality of removable interchangeable sleeves, each sleeve having an exterior surface with a discrete cleansing surface thereon allowing a user to vary the cleansing surface of the scrubber as desired;

a motor means for automatically rotating said brush member allowing a user to place the user's back thereagainst for cleansing;

a peg upwardly extending from said lower arm, said peg operably connected to said motor means whereby activation of said motor means results in rotation of said peg, said peg removably received within said bore on the lower end of said brush member;

a spring-biased pin depending from the upper arm, said pin removably received within the bore on the upper end of said brush member allowing said brush member to be removably attached to said bracket.

2. The back scrubber according to claim 1 wherein said bracket is secured to said vertical support surface with screws.

3. The back scrubber according to claim 1 wherein said bracket is secured to the vertical support surface with suction cups.

* * * * *